US005911637A

United States Patent [19]

Yamagata

[11] Patent Number: 5,911,637

[45] Date of Patent: Jun. 15, 1999

[54] GOLF CLUB

[76] Inventor: Shinichi Yamagata, 21-5, Hakuho-dai 2-chome, Kashiba, Nara, Japan

[21] Appl. No.: 08/968,556

[22] Filed: Nov. 12, 1997

[30] Foreign Application Priority Data

Feb. 28, 1997 [JP] Japan ..... 9-045791

[51] Int. Cl.[6] ..... A63B 69/36

[52] U.S. Cl. ..... 473/333

[58] Field of Search ..... 473/333, 519, 473/233, 231, 457

[56] References Cited

U.S. PATENT DOCUMENTS

| | | | |
|---|---|---|---|
| 690,490 | 1/1902 | Febiger | 473/333 |
| 1,825,244 | 9/1931 | Nero | 473/333 |
| 2,592,013 | 4/1952 | Curley | 473/333 |
| 3,116,926 | 1/1964 | Owen | 473/519 |
| 3,589,731 | 6/1971 | Chancellor | 473/333 |
| 3,677,553 | 7/1972 | Moore . | |
| 4,135,720 | 1/1979 | Lancellotti | 473/233 |
| 4,325,549 | 4/1982 | Vasselli | 473/519 |
| 4,461,481 | 7/1984 | Kim | 473/333 |
| 5,366,222 | 11/1994 | Lee | 473/333 |
| 5,482,282 | 1/1996 | Willis | 473/342 |

*Primary Examiner*—Sebastiano Passaniti
*Attorney, Agent, or Firm*—Wenderoth, Lind & Ponack, L.L.P.

[57] ABSTRACT

A golf club, which can increase the carry of a ball without increasing the shaft length, has a hollow head in which are mounted a weight and a mechanism for resiliently pressing the weight against the inner surface of the face of the head. In one embodiment, during a forward swing of the club, the weight separates while compressing a spring due to static inertia. When the head impacts the ball, the face dents momentarily and the weight hits against the dented face.

6 Claims, 5 Drawing Sheets

GOLF CLUB

BACKGROUND OF THE INVENTION

This invention relates to a golf club that promises an increased carry of a golf ball.

The greater the energy applied to a golf ball when golf club head collides against the ball, the longer he carry of the ball. To increase such collision energy, the head speed has to be increased. But increasing the head speed is not an easy job for a golfer.

To increase the carry, some golfers use clubs with heavier heads, while others use clubs with longer shafts.

But using clubs that are too heavy or too long tends to disfigure the swinging form and follow-through, thus increasing the possibility of shortening the carry, rather than increasing the carry.

An object of this invention is to provide a golf club which can increase the carry of a ball without increasing the head weight, shaft length or swing speed.

SUMMARY OF THE INVENTION

According to this invention, there is provided a golf club comprising a hollow head having a face adapted to be resiliently deformed when impacted on a golf ball, a weight and a resilient member mounted in the head. The resilient member serves to press the weight against the inside surface of the face, the weight being mounted so as to move in the head while resiliently deforming the resilient member under static inertia of the weight while the club is being swung forward.

There is also provided a golf club comprising a hollow head having a face adapted to be resiliently deformed when impacted on a golf ball, a weight movably mounted in the hollow head, and a pair of permanent magnets mounted in the head. The permanent magnets have their magnetic surfaces of the same polarity facing each other so that the weight is pressed against the inside surface of the face by the magnetic repulsion force produced between the magnets. The magnets are arranged such that the distance therebetween decreases when the weight moves during a forward swing of the golf club.

It is well-known that a steel-shafted golf club can carry a ball a longer distance than a carbon-shafted golf club. This is because a carbon shaft is resiliently bent more remarkably than a steel shaft while the club is being swung, so that the resilient repulsion force of the shaft can increase the carry of the ball.

The golf club according to the present invention can carry a ball a long distance for a similar reason to the above. That is, during a forward swing of the club, the weight in the head moves relative to the head due to inertia, while resiliently deforming the resilient member (or moving the pair of magnets closer to each other against the repulsion force therebetween). Thus, repulsion force is stored. When the head impacts the ball, the energy due to the stored repulsion force and the inertia of the weight is released as a ball driving force. During a forward swing of the club, the weight initially moves backward, and the moment the head impacts the ball, the weight is moved forward by the inertia and the repulsion force, hitting the face from behind. When the head impacts the ball, the face dents momentarily and then springs back to the original state. Thus, the collision energy produced when the weight hits against the face is transmitted through the face to the ball, which is still in contact with the face of the head. The ball thus reaches a longer distance.

Other features and objects of the present invention will become apparent from the following description made with reference to the accompanying drawings, in which:

DETAILED DESCRIPTION OF THE PREFERRED EMBODIMENT

Figure 1A:
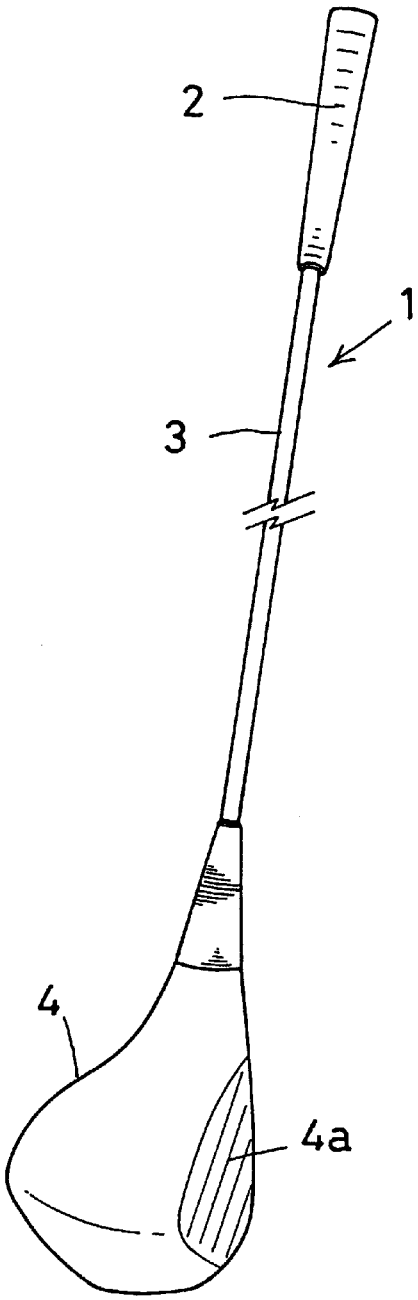
FIG. 1A is a perspective view of an embodiment of the golf club according to this invention.
Figure 1B:
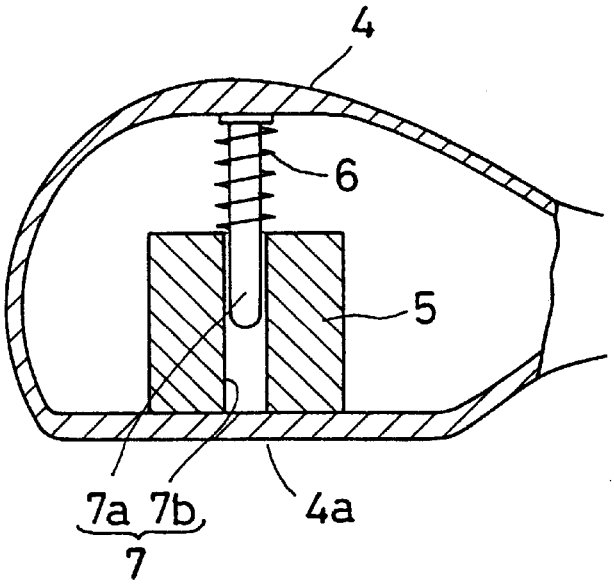
FIG. 1B is an enlarged sectional plan view of the club head of FIG. 1A.
Figure 1C:
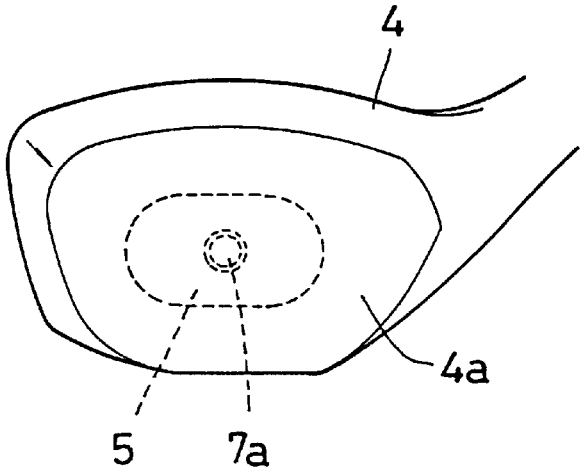
FIG. 1C is a front view thereof.

FIGS. 1A–1C show an embodiment of this invention. This golf club 1 comprises a shaft 3 having a grip 2, and a head 4 provided at the leading end of the shaft 3. In its outer appearance, this club appears no different than ordinary drivers and woods.

The head 4 is a hollow member made from a material which can withstand the impact on balls, such as titanium or a titanium alloy. If strong enough, it may be made by boring a hole in a wood member.

Mounted in the head 4 are a weight 5, a spring 6 biasing the weight 5 against the back of the face 4*a* of the head 4, and a slide guide 7 for stabilizing the movement of the weight 5.

The spring 6 may be, instead of the illustrated coil spring, a plurality of stacked disk springs or a volute spring. The slide guide 7 comprises a guide pin 7*a* secured to the inner side of the head 4 and inserted in a guide hole 7*b* formed in the weight 5. This arrangement is preferable because the guide pin 7*a* can support the spring 6. But the slide guide may be a groove along which the weight 5 is guided to stabilize the movement of the weight. The slide guide may be omitted.

Figure 2:
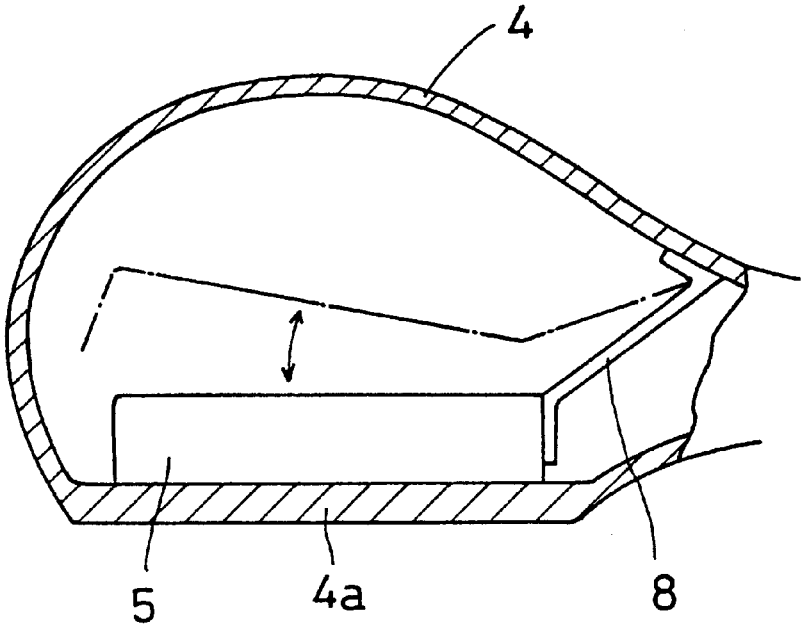
FIG. 2 is an enlarged sectional plan view of a portion of another embodiment.

FIG. 2 shows another embodiment. In this embodiment, the weight 5 in the head 4 is supported by a leaf spring (or wire spring) 8. The leaf spring 8 has one end thereof secured to the inner surface of the head 4. The weight 5 is mounted on the other, free end of the leaf spring 8. With this arrangement, no slide guide is needed for stable movement of the weight 5.

Figure 3:
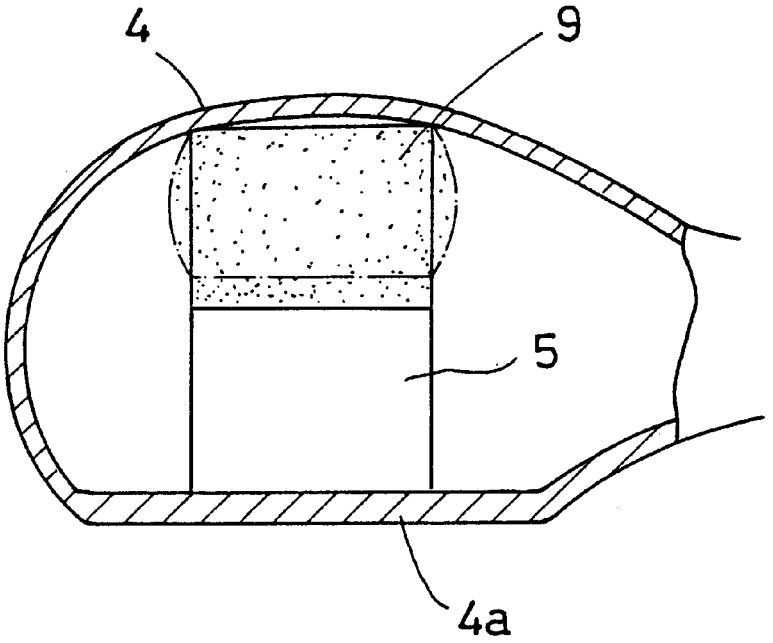
FIG. 3 is an enlarged sectional plan view of a portion of still another embodiment.

In the embodiment of FIG. 3, a rubber member 9 is used instead of the spring. The rubber member 9 can produce a required repulsion force. But considering durability, a spring (especially a metallic spring) or a permanent magnet, to be described below, is preferable to rubber.

In use, when the golf club is swung forward, the weight 5 separates from the inner side of the face 4*a* while resiliently deforming the resilient member (spring 6, leaf spring 8, or rubber 9) due to static inertia. Then, at the moment of impact on the ball, the face 4*a* momentarily dents, and the weight 5 collides against the inner wall of the dented face 4*a* biased by the resilient member. This amplifies the resilient restoring force of the face 4*a*. This force is transmitted to the ball, making it possible to carry the ball a longer distance.

Figure 4:
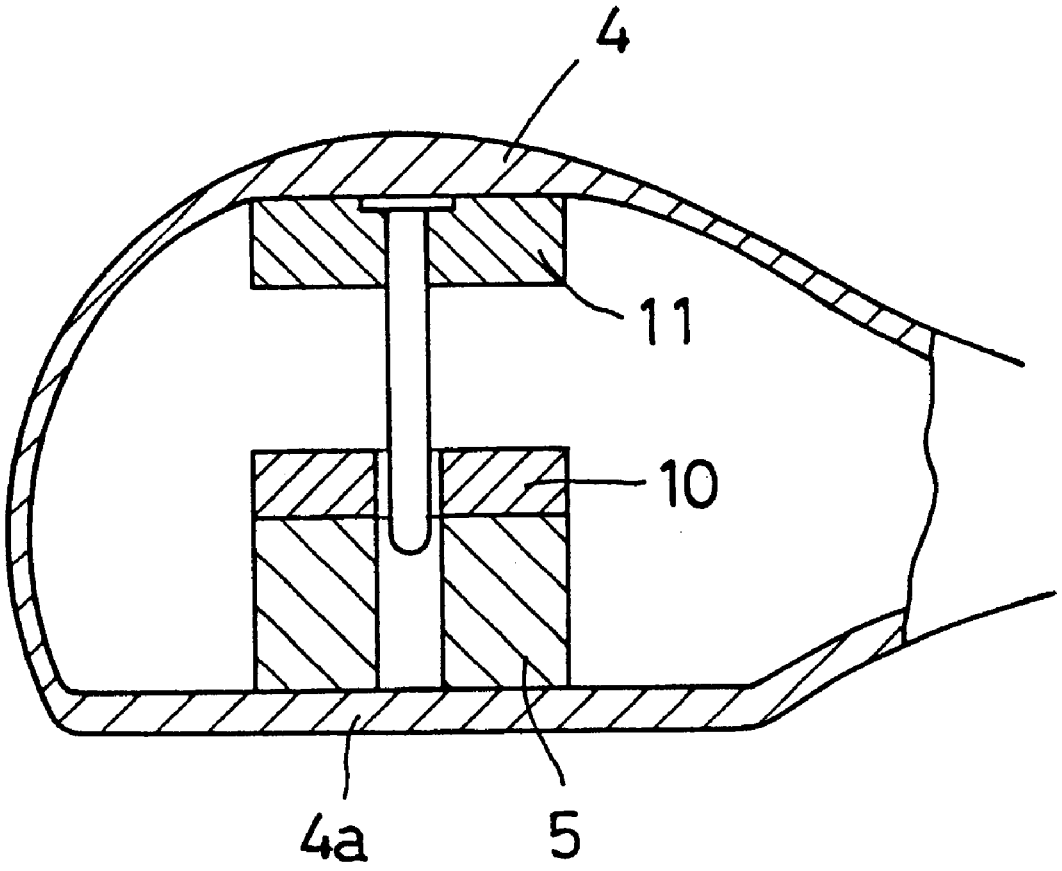
FIG. 4 is an enlarged sectional plan view of a portion of a further embodiment.

In the embodiment of FIG. 4, a pair of permanent magnets 10, 11 are used instead of the resilient member. The magnet 10 is fixed to the back of the weight 5, while the magnet 11 is fixed to the inner surface of the head 4, with their magnetic surfaces of the same polarity facing each other so that magnetic repulsion force is produced between the magnets 10 and 11. This force keeps the weight 5 pressed against the back of the face 4*a*.

The weight 5 itself may be the permanent magnet 10. In this case, the head 4 and a sole plate, if the head has a sole plate, are made of a non-magnetizable material.

Figure 5A:
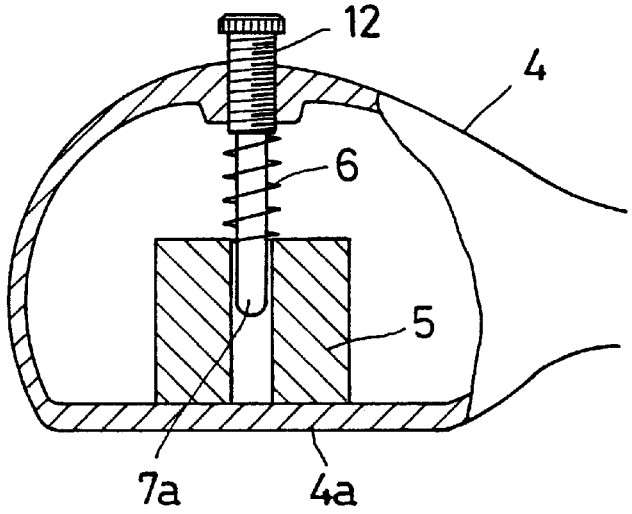
FIGS. 5A–5C are sectional views of portions of other embodiments.
Figure 5B:
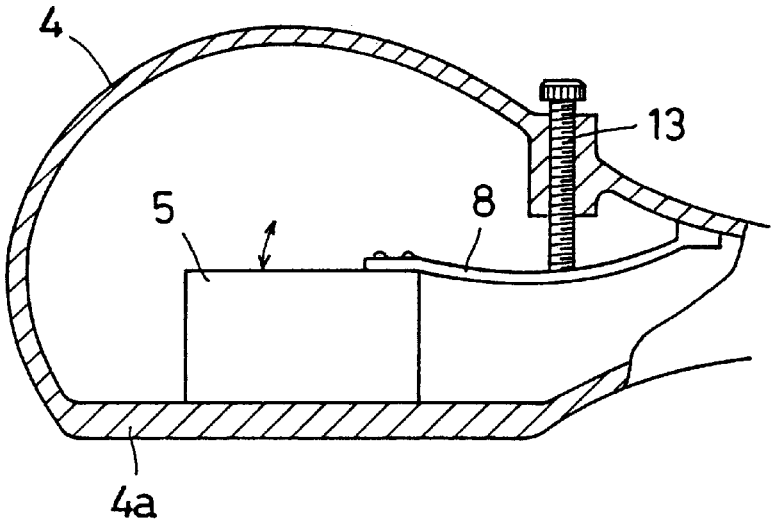
Figure 5C:
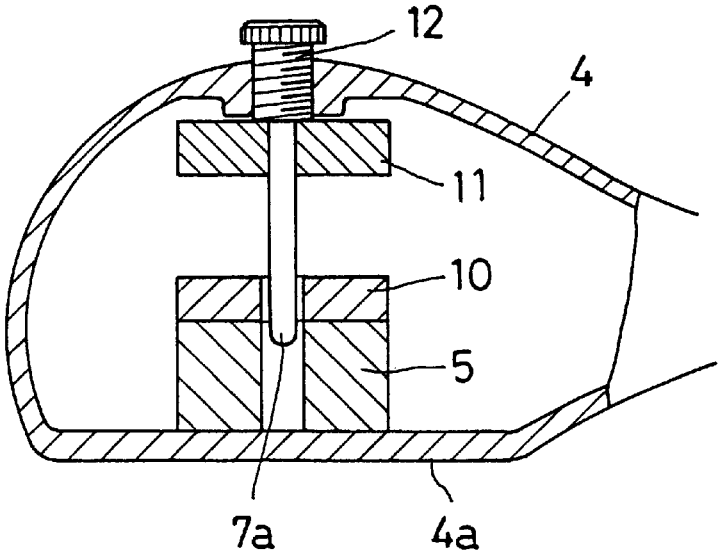

In the embodiment of FIG. 5, a guide pin 7*a* with an adjusting screw 12 is threaded into the head 4. By adjusting the length of threaded engagement, the set load of the spring 6 is variable. If the set load of the spring 6 is so weak that the weight 5 moves to the terminal end when the club is swung forward, the repulsion force will not increase any further no matter how fast the head speed. On the other hand, if the head speed is too slow even though the set load of the spring 6 is large, the weight 5 will not move in the head. The golf club shown in FIG. 5A is free of this problem. That is, this club can store repulsion force corresponding to the head speed.

As shown in FIG. 5B, by threading the adjusting screw 13 into the head 4 to press the leaf spring 8 with the screw 13, the set load of the spring is applied to the weight 5.

In the embodiment in which permanent magnets are used, it is possible to vary the initial repulsion force by mounting the permanent magnet 11 in an adjustable position and adjusting the distance between the magnets 10 and 11.

Figure 6:
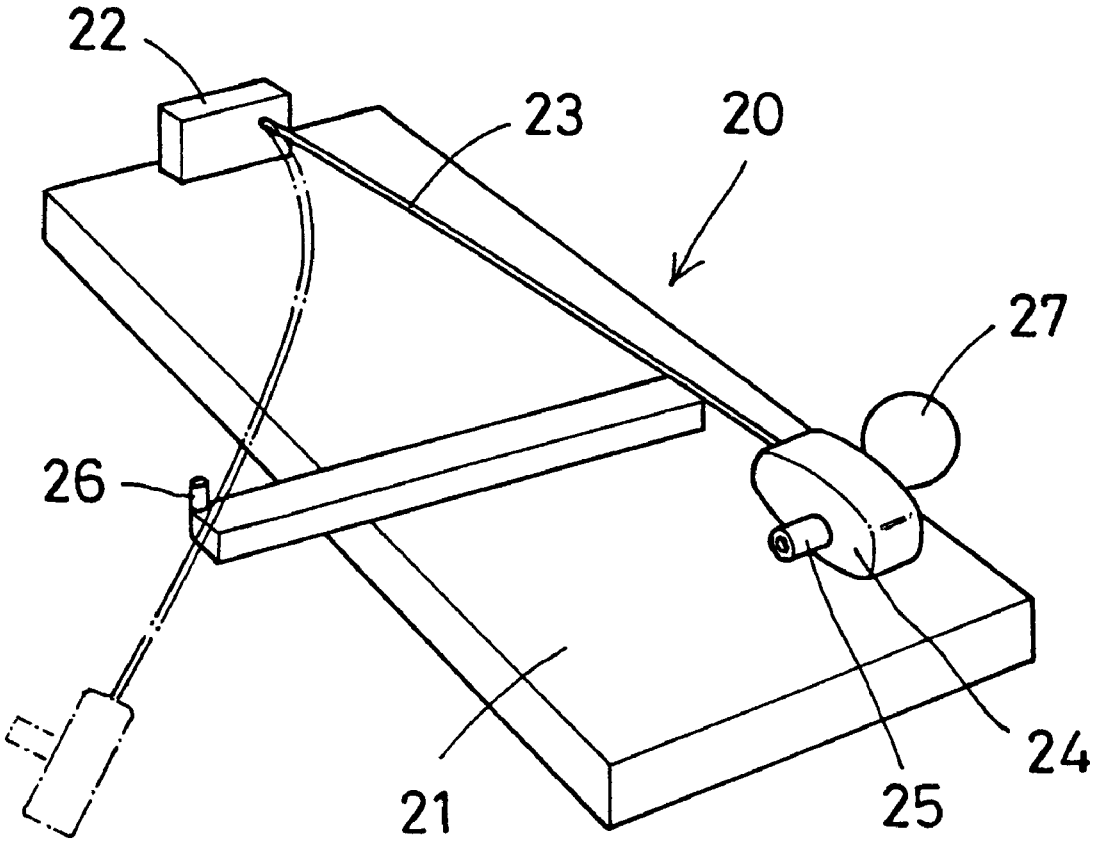
FIG. 6 is a perspective view of a test device used to verify the effects of the golf club of the invention.

FIG. 6 shows a test device used to verify the effects of this invention. This test device 20 has a support member 22 provided on a base plate 21. An imitation golf club is mounted to the support member 22. The club comprises a carbon rod shaft 23 (which is actually part of a fishing rod) and a wooden head 24 mounted on the tip of the shaft 23. A plate imitating the club face 4*a* is mounted on the front of the head 24.

Using this device, the carry of the ball was compared when a weight 25 was fixedly screwed to the head 24, versus when the same weight 25 was mounted in the head 24 and pressed against the back of the plate by a coil spring.

In the test, the rod shaft 23 was resiliently bent until it abuts a stopper 26 and tied to the stopper by thread. Then, the thread was cut with a cutter to let the rod resiliently swing toward a ball 27 set in a stationary position to hit the ball with the head 24.

When the ball was driven by the club having the weight 25 fixed to the head 24, the ball flew substantially the same distance and reached substantially the same spot in repeated tests.

In contrast, when the ball was hit by the club having its weight 25 pressed against the plate by the coil spring, the carry significantly increased. The head weights of the above two clubs including the weights were substantially the same (though, in a strict sense, there is a slight difference due to the coil spring provided in one club). The reason why the ball flew a longer distance when hit by the club according to the invention is considered to be because the weight collides against the plate which momentarily has dented when the head impacts the ball, and the collision force is transmitted to the ball through the plate.

The difference in flying distance of the ball was 6–15 cm, which represents about a 5–10% increase. Thus, a significant increase in the ball carry is expected if this spring-biased weight system is employed in a real golf club.

As described above, while the golf club according to this invention is being swung forward, due to the inertia of the weight, repulsion force is stored in the resilient member or the pair of permanent magnets. When the head impacts the ball, the moving energy of the weight due to the repulsion force stored and the inertia of the weight are transmitted to the ball. Thus, it is possible to increase the ball carry without increasing the shaft length or swing speed.

There is no need to use an oversized club to increase the carry. Thus, one can maintain good swinging form and follow-through. This reduces the possibility of erroneous shots.

What is claimed is:

1. A golf club comprising a hollow head having a face adapted to be resiliently deformed when impacted on a golf ball, a weight mounted in said head, a spring having a first end secured to said weight and a second end secured to an inner wall of said head for normally pressing said weight against an inside surface of said face in a yieldable manner such that said weight moves away from said inside surface of said face under static inertia of said weight while the club is being swung forward.

2. A golf club as claimed in claim 1 further comprising an adjusting screw axially movably extending through a wall of said head and having an inner end pressed against said spring.

3. A golf club as claimed in claim 1, wherein said spring comprises a leaf spring.

4. A golf club comprising a hollow head having a face adapted to be resiliently deformed when impacted on a golf ball, a weight movably mounted in said hollow head, a pair of permanent magnets mounted in said head, said permanent magnets having their magnetic surfaces of the same polarity facing each other so that said weight is pressed against an inside surface of said face by the magnetic repulsion force produced between said magnets, said magnets being arranged such that a distance therebetween decreases when the weight moves during a forward swing of the golf club.

5. A golf club as claimed in claim 4, further comprising an adjusting screw axially movably extending through a wall of said head and having an inner end operably coupled with one of said permanent magnets such that axial movement of said adjusting screw effects adjustment of a maximum distance between said permanent magnets.

6. A golf club as claimed in claim 4, wherein one of said permanent magnets is secured to and movable with said weight.

* * * * *